US011330371B2

(12) United States Patent
Carlsson et al.

(10) Patent No.: US 11,330,371 B2
(45) Date of Patent: May 10, 2022

(54) AUDIO CONTROL BASED ON ROOM CORRECTION AND HEAD RELATED TRANSFER FUNCTION

(71) Applicant: SONY GROUP CORPORATION, Tokyo (JP)

(72) Inventors: Gregory Carlsson, San Diego, CA (US); James R. Milne, San Diego, CA (US)

(73) Assignee: SONY GROUP CORPORATION, Tokyo (JP)

( * ) Notice: Subject to any disclaimer, the term of this patent is extended or adjusted under 35 U.S.C. 154(b) by 12 days.

(21) Appl. No.: 17/079,625

(22) Filed: Oct. 26, 2020

(65) Prior Publication Data

US 2021/0144475 A1 May 13, 2021

Related U.S. Application Data

(60) Provisional application No. 62/931,946, filed on Nov. 7, 2019.

(51) Int. Cl.
*H04R 3/04* (2006.01)
*H04S 7/00* (2006.01)

(52) U.S. Cl.
CPC ..... *H04R 3/04* (2013.01); *H04S 7/306* (2013.01); *H04S 7/307* (2013.01); *H04R 2430/20* (2013.01); *H04S 2420/01* (2013.01)

(58) Field of Classification Search
CPC ..... H04R 3/04; H04R 2430/20; H04S 7/306; H04S 7/307; H04S 2420/01
See application file for complete search history.

(56) References Cited

U.S. PATENT DOCUMENTS 6,574,339 B1 * 6/2003 Kim ..... H04S 3/00 381/17
8,675,880 B2 * 3/2014 De Bruijn ..... H04S 7/303 381/17
9,578,440 B2 * 2/2017 Otto ..... H04S 5/00
9,848,273 B1 12/2017 Helwani et al.
2003/0179891 A1 * 9/2003 Rabinowitz ..... H04R 3/12 381/103

(Continued)

*Primary Examiner* — Fan S Tsang
*Assistant Examiner* — Daniel R Sellers
(74) *Attorney, Agent, or Firm* — Chip Law Group

(57) ABSTRACT

An audio reproduction device and method for audio control based on room-correction (RC) and head related transfer function (HRTF) are provided. The audio reproduction device includes a speaker that reproduces a first audio signal. The audio reproduction device receives a plurality of second audio signals indicative of frequency responses captured based on the first audio signal and captured by a plurality of audio capturing devices positioned on a head wearable device of a user present within an enclosed physical space. The audio reproduction device determines RC preset for one or more RC filters associated with the speaker, based on the captured frequency responses. The audio reproduction device further determines HRTF associated with the user based on the captured frequency responses, and user-specific information of the user. The audio reproduction device further controls audio reproduction of the speaker based on the determined RC preset and the determined HRTF.

18 Claims, 6 Drawing Sheets

(56) References Cited

U.S. PATENT DOCUMENTS

| | | | | |
|---|---|---|---|---|
| 2003/0190047 | A1* | 10/2003 | Aarts | H04S 3/004 381/310 |
| 2006/0045294 | A1* | 3/2006 | Smyth | H04S 7/304 381/309 |
| 2006/0056638 | A1* | 3/2006 | Schobben | H04S 1/002 381/17 |
| 2008/0130408 | A1* | 6/2008 | Pfaffinger | H04S 7/00 367/13 |
| 2011/0286614 | A1* | 11/2011 | Hess | H04S 7/303 381/302 |
| 2012/0185769 | A1* | 7/2012 | Whitley | H04H 60/04 715/716 |
| 2016/0353224 | A1* | 12/2016 | Reilly | G06F 3/165 |
| 2017/0026770 | A1* | 1/2017 | Patel | H04R 3/12 |
| 2017/0078820 | A1 | 3/2017 | Brandenburg et al. | |
| 2018/0035226 | A1 | 2/2018 | Reijniers et al. | |
| 2019/0289417 | A1 | 9/2019 | Tomlin et al. | |
| 2021/0089263 | A1* | 3/2021 | Milne | H04R 3/12 |

* cited by examiner

AUDIO CONTROL BASED ON ROOM CORRECTION AND HEAD RELATED TRANSFER FUNCTION

CROSS-REFERENCE TO RELATED APPLICATIONS/INCORPORATION BY REFERENCE

This application claims priority to U.S. Provisional Patent Application Ser. No. 62/931,946 filed on Nov. 7, 2019, the entire content of which is hereby incorporated herein by reference.

FIELD

Various embodiments of the disclosure relate to audio reproduction. More specifically, various embodiments of the disclosure relate to an audio reproduction device and method for audio control based on room correction and head related transfer function.

BACKGROUND

Recent advancements in the field of audio reproduction devices (such as, televisions, and speakers) have led to development of various technologies and systems to enhance reproduction of audio content. Typically, when an audio reproduction device located within an enclosed physical space (such as, a room or a cinema hall) reproduces audio content, a user (such as, one or more persons present within the enclosed physical space) may hear sound associated with different audio frequency responses for the same reproduced audio content. Such a variation of the sound may be due to various factors, such as, a distance of the user from the audio reproduction device, an absorption and/or a reflection of the audio due to the surrounding environment (such as, furniture, curtain, and walls) of the enclosed physical space or user-specific parameters (such as, a head size or an ear size). However, in certain situations, the audio reproduction device may employ conventional techniques in order to match audio frequency responses heard by the user, with the audio frequency response of the reproduced audio content to provide an optimum sound experience in the enclosed physical space. However, in certain situations, with the variation with number of users present in the enclosed physical space or variation in the user-specific parameters of the user, the optimal sound experience may be affected.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

An audio reproduction device and method for audio control based on room correction and head related transfer function is provided substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Figure 1:
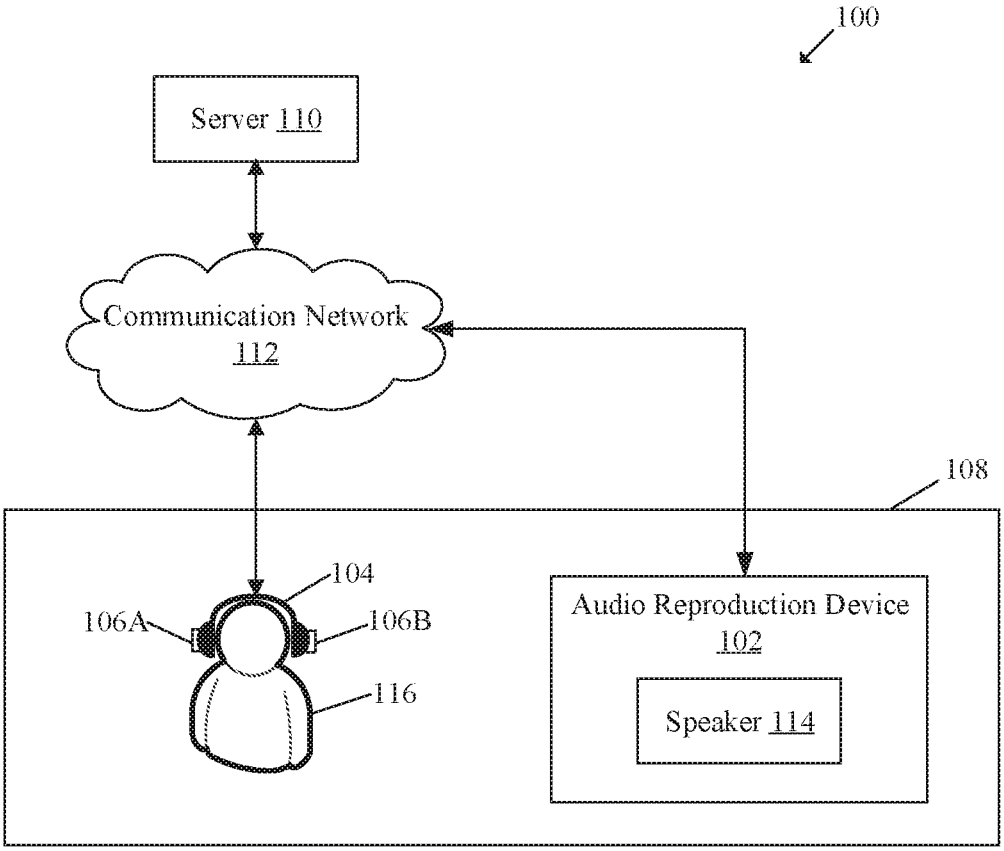
FIG. 1 is a block diagram that illustrates an exemplary network environment for an audio reproduction device for audio control based on room correction and head related transfer function, in accordance with an embodiment of the disclosure.

The following described implementations may be found in the disclosed audio reproduction device and method for audio control based on room correction and head related transfer function. Exemplary aspects of the disclosure provide an audio reproduction device (for example, a television (TV), an audio video receivers (AVRs), and other audio reproduction devices) that may control audio reproduction of a speaker (such as, a loudspeaker, a soundbar, a woofer, and the like) in an enclosed physical space (such as, a room, a hall, and the like). The audio reproduction device may be configured to receive a plurality of audio signals captured by a plurality of audio capturing devices (such as, recorders, dynamic microphones, or other microphones). The reception of the plurality of audio signals may allow the audio reproduction device to dynamically determine frequency responses captured for audio signals reproduced by the speaker of the audio reproduction device. The plurality of audio capturing devices may be positioned on a head wearable device (such as, a headphone) of a user present within the enclosed physical space. Based on the determined frequency responses, the audio reproduction device may be further configured to determine a room-correction (RC) preset for one or more RC filters associated with the speaker. Such RC preset may be employed by the speaker in order to provide dynamic control of room correction of sound present in the enclosed physical space for a particular location of the user (i.e. listener). The RC preset may be pre-calibrated for the particular location at which the frequency response may be captured, to provide the room correction in the enclosed physical space. The audio reproduction device may be further configured to determine a head related transfer function (HRTF) associated with the user for one or more HRTF filters associated with the speaker, based on the frequency responses determined for the received plurality of audio signals and user-specific information corresponding to the user. In an embodiment, the user-specific information may include, but is not limited to, dimensions of a head of the user, dimensions of ears of the user, dimensions of ear canals of the user, dimensions of a shoulder of the user, dimensions of a torso of the user, a density of the head of the user, or an orientation of the head of the user. The audio reproduction device may be further configured to control the audio reproduction of the speaker based on the determined RC preset corresponding to the location within the enclosed physical space, and further based on the determined HRTF corresponding to the user present within the enclosed physical space. Therefore, the disclosed audio reproduction device achieves audio reproduction control based on combination of the room correction (RC) preset and the HRTF, thereby enhance sound experience for the user present in the enclosed physical space in a real time. In an embodiment, the disclosed audio reproduction device may determine a contribution of the room correction (RC) and head related transfer function (HRTF) to control the audio reproduction, based on different factors such as, but not limited to, user inputs, number of users (i.e. listeners) present in the enclosed physical space, and pre-stored RC presets or HRTF related values/parameters.

FIG. 1 is a block diagram that illustrates an exemplary network environment for an audio reproduction device for audio control based on room correction and head related transfer function, in accordance with an embodiment of the disclosure. With reference to FIG. 1, there is a diagram of a network environment 100. The network environment 100 may include an audio reproduction device 102, a head wearable device 104, a plurality of audio capturing devices 106A-106B (such as, a first audio capturing device 106A and a second audio capturing device 1068) present within an enclosed physical space 108, and a server 110. The audio reproduction device 102, the head wearable device 104, and the plurality of audio capturing devices 106A-106B may be communicatively coupled to the server 110, via a communication network 112. Further, the head wearable device 104 and the plurality of audio capturing devices 106A-106B may be communicatively coupled with the audio reproduction device 102, via the communication network 112. The audio reproduction device 102 may further include a speaker 114 configured to reproduce a first audio signal (i.e. sound). In the network environment 100, there is further shown a first user 116 associated with the audio reproduction device 102 present within the enclosed physical space 108. It may be noted that the speaker 114 included in the audio reproduction device 102 in FIG. 1 is presented merely as an example. In some embodiments, the speaker 114 may be external to the audio reproduction device 102 and may be communicably coupled to the audio reproduction device 102, without deviating from the scope of disclosure. In such case, the speaker 114 may be present in the enclosed physical space 108 and the audio reproduction device 102 may be present outside the enclosed physical space 108.

Further, as shown in FIG. 1, the plurality of audio capturing devices 106A-106B may be positioned on the head wearable device 104 of the first user 116. It may be noted that the head wearable device 104, the first audio capturing device 106A, and the second audio capturing device 1068, shown in FIG. 1 are presented merely as an example. The network environment 100 may include other forms of the head wearable device 104, the first audio capturing device 106A and the second audio capturing device 1068 without deviating from the scope of the disclosure. In some embodiments, the plurality of audio capturing devices 106A-106B may include only one audio capturing device or more than one audio capturing device, without deviating from the scope of the disclosure.

The audio reproduction device 102 may include suitable logic, circuitry, code and/or interfaces that may be configured to control audio reproduction of the speaker 114 in the enclosed physical space 108 based on room correction (RC) and HRTF applied on the speaker 114. The audio reproduction device 102 may be configured to receive a plurality of audio signals captured by a plurality of audio capturing devices (such as, the first audio capturing device 106A and the second audio capturing device 106B) which may be positioned on the head wearable device 104 of the first user 116 present within the enclosed physical space 108. Each of the plurality of audio signals may indicate a frequency response captured based on the first audio signal reproduced by the speaker 114. Based on the frequency responses captured in the received plurality of second audio signals, the audio reproduction device 102 may be configured to determine a room-correction (RC) preset for one or more RC filters associated with the speaker 114 for a particular location of the first user 116 within the enclosed physical space 108. The audio reproduction device 102 may be further configured to determine a head related transfer function (HRTF) associated with the first user 116 based on the frequency responses captured in the received plurality of second audio signals and user-specific information corresponding to the first user 116. Based on the determined RC preset corresponding to the location within the enclosed physical space 108, and further based on the determined HRTF corresponding to the first user 116 present within the enclosed physical space 108, the audio reproduction device 102 may be configured to control the audio reproduction of the speaker 114. Examples of the audio reproduction device 102 may include, but are not limited to, a television (TV), an audio video receivers (AVRs), a soundbar, a sound system, a home theater system, radio receivers, tape recorders with audio reproduction capability, an audio amplifier, audio mixing console, loudspeakers, speakers, or other audio reproduction devices.

The head wearable device 104 may include suitable logic, circuitry, and/or interfaces that may be worn by the first user 116 to capture a plurality of second audio signals, via the plurality of audio capturing devices 106A-106B, for the first audio signal reproduced by the speaker 114. In some embodiments, the head wearable device 104 may be configured to control playback of multimedia content and other control functions based on different user inputs received from the first user 116. The user inputs may be received from the first user 116 via the plurality of audio capturing devices 106A-106B. In such case, the user inputs may correspond to audio inputs (or voice inputs) from the first user 116. In certain embodiments, the user input may correspond to an input other than a voice input (or an audio input) received from the first user 116. Examples of such user input may include, but are not limited to, a button press input, a touch input, a gesture input, a physical tap, or a haptic input. In certain embodiments, the user input may be represented as an instruction, such as an audio input) for the head wearable device 104.

Examples of the head wearable device 104 may include, but are not limited to, a head mounted device, a head worn device, headphone, an audio-video (AV) entertainment device, an earphone, a smart glass, a virtual-reality (VR) device, a display device worn on the head of the first user 116, a video-conferencing device worn on the head of the first user 116, a gaming device worn on the head of the first user 116, and/or a consumer electronic (CE) device worn on the head of the first user 116. In accordance with an embodiment, a media player device (not shown) may be integrated with the head wearable device 104. The media player device may be configured to store, decode, and output the multimedia content to different components, for example, a display, a set of speakers, or in-ear speakers, of the head wearable device 104. Examples of the media player device may include, but are not limited to, an audio player, a VR player, and an audio/video (A/V) player.

The plurality of audio capturing devices 106A-106B may include suitable logic, circuitry, code and/or interfaces that may be configured to capture the plurality of second audio signals for the first audio signal (i.e. sound) reproduced from the speaker 114. The plurality of audio capturing devices 106A-106B may further generate a frequency response of the captured plurality of second audio signals. In an embodiment, the frequency responses of the plurality of second audio signals captured by the plurality of audio capturing devices 106A-106B may be different from a frequency response of the first audio signal reproduced by the speaker 114 due to certain factors (such as sound reflections or absorption done by objects or walls of the enclosed physical space 108). In some embodiments, the plurality of audio capturing devices 106A-106B may be communicatively coupled with the head wearable device 104 and may be positioned on the head wearable device 104. In some embodiments, the plurality of audio capturing devices 106A-106B may be integrated within the head wearable device 104 and may be a component of the head wearable device 104 and the entire functionality of the plurality of audio capturing devices 106A-106B may be included in the head wearable device 104. Examples of the plurality of audio capturing devices 106A-106B may include, but are not limited to, a recorder, an electret microphone, a dynamic microphone, a stereo microphone, a carbon microphone, a piezoelectric microphone, a fiber microphone, a micro-electro-mechanical-systems (MEMS) microphone, or other microphones.

In the network environment 100, the audio reproduction device 102, the head wearable device 104, the plurality of audio capturing devices 106A-106B, and the first user 116 may be located within the enclosed physical space 108. The enclosed physical space 108 may include a three-dimensional physical area that may be surrounded by walls and have a defined physical dimension in a physical environment. Examples of the enclosed physical space 108 may include, but are not limited to, a room, a hall or other enclosed areas.

The speaker 114 may include suitable logic, circuitry, code and/or interfaces that may be configured to reproduce the first audio signal (for example a song, a test tone, or a musical tone) associated with the audio reproduction device 102. The speaker 114 may be configured to receive electrical signals or instructions (i.e. related to the first audio signal) from the audio reproduction device 102, and convert the received electrical signals or instructions into an audio output. In some embodiments, the speaker 114 may be integrated with the audio reproduction device 102. The speaker 114 may be an internal component of the audio reproduction device 102 and the entire functionality of the speaker 114 may be included in the audio reproduction device 102. In some embodiments, the speaker 114 may be communicatively coupled with the audio reproduction device 102 and may be positioned within the enclosed physical space 108. Examples of the speaker 114 may include, but are not limited to, an external wireless speaker, a set of internal speakers, an external wired speaker, a woofer, a sub-woofer, a tweeter, a soundbar, a loudspeaker, a monitor speaker, an optical audio device, or other speakers or sound output device that may be communicatively coupled to the audio reproduction device 102 through the communication network 112 or integrated in the audio reproduction device 102.

The server 110 may include suitable logic, circuitry, and interfaces, and/or code that may be configured to transmit audio content or the multimedia content to the audio reproduction device 102. The server 110 may be further configured to store the audio content. In some embodiments, the server 110 may be configured to store the determined RC preset corresponding to the location within the enclosed physical space 108, and store the determined first HRTF corresponding to the first user 116 present within the enclosed physical space 108. The server 110 may further provide a first value of at least one coefficient of the one or more HRTF filters and a second value of at least one coefficient of the one or more RC filters to the audio reproduction device 102 for audio control based on the room correction (RC) and the head related transfer function (HRTF). The server 110 may be implemented as a cloud server and may execute operations through web applications, cloud applications, HTTP requests, repository operations, file transfer, and the like. Other example implementations of the server 110 may include, but are not limited to, a database server, a file server, a web server, a media server, an application server, a mainframe server, or a cloud computing server.

The communication network 112 may include a communication medium through which the audio reproduction device 102, the head wearable device 104, the plurality of audio capturing devices 106A-106B, the server 110, and the speaker 114 may communicate with each other. The communication network 112 may be one of a wired connection or a wireless connection Examples of the communication network 112 may include, but are not limited to, the Internet, a cloud network, a Wireless Fidelity (Wi-Fi) network, a Personal Area Network (PAN), a Local Area Network (LAN), or a Metropolitan Area Network (MAN). Various devices in the network environment 100 may be configured to connect to the communication network 112 in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

In operation, the audio reproduction device 102 may be configured to receive a user input, (for example, to turn-on the audio reproduction device 102) which may further allow the audio reproduction device 102 to dynamically control the audio reproduced based on the RC preset and the HRTF. The audio reproduction device 102 may be configured to receive the user input via the head wearable device 104 or from I/O device (shown in FIG. 2) of the audio reproduction device 102. The speaker 114 may be configured to reproduce a first audio signal, for example a predefined sound. The audio reproduction device 102 may be further configured to receive a plurality of second audio signals captured by the plurality of audio capturing devices 106A-106B which may be positioned on the head wearable device 104 of the first user 116 (i.e. listener) present within the enclosed physical space 108. The plurality of audio capturing devices 106A-

106B may be positioned on the head wearable device 104 in a manner that each of the plurality of audio capturing devices 106A-106B may be present in proximity to an opening of each ear of the first user 116. This may allow the audio reproduction device 102 to capture two audio signals which may be actually heard by the ears of the first user 116 in the enclosed physical space 108. The reception of the plurality of second audio signals is further described, for example, in FIG. 3A. Each of the plurality of second audio signals may be indicative of the frequency response captured based on the first audio signal reproduced by the speaker 114. The first audio signal may indicate an output of the speaker 114 and the plurality of second audio signals may indicate the sound captured by the plurality of audio capturing devices 106A-106B for the first audio signal output by the speaker 114. The captured frequency response may indicate an audio response (such as, impulse response) of the enclosed physical space 108, captured based on the first audio signal reproduced by the speaker 114.

The audio reproduction device 102 may be further configured to determine the RC preset for the one or more RC filters associated with the speaker 114, based on the frequency responses captured in the received plurality of second audio signals. The RC preset may be determined based on comparison of the frequency response of the first audio signal reproduced by the speaker 114 and an average frequency response of the plurality of second audio signals. The determined RC preset may correspond to a location of the first user 116 within the enclosed physical space 108. In some embodiments, the audio reproduction device 102 may be configured to determine a plurality of RC presets corresponding to each possible location of the first user 116 within the enclosed physical space 108. Each of the determined plurality of RC presets may be pre-calibrated information to control the audio reproduction of the speaker 114 to perform the room correction within the enclosed physical space 108. The determined RC preset may include information to control the first audio signal reproduced by the speaker 114 to perform room correction for a particular location within the enclosed physical space 108. For example, the determined RC preset may include, but is not limited to information about an amplitude or a gain level of a particular frequency, information about amplification or attenuation corresponding to the particular frequency, information about a frequency range, a center frequency value, a quality factor (Q), bandwidth information, or delay information. For example, the determined RC preset may indicate a value of the amplitude or gain level (in dB) for the particular frequency (or for the RC filter 208A shown in FIG. 2) to perform audio equalization and the room correction. In another example, the determined RC preset may indicate the amplification or attenuation corresponding to the particular frequency in order to control the speaker 114 to provide desired sound output for the particular location in the enclosed physical space 108. In another example, the determined RC preset may indicate the frequency range, or the bandwidth which has to be equalized to a particular amplitude/gain level. In another example, the determined RC preset may indicate the delay information (in milliseconds or microseconds) which may indicate a time delay to be provided in the audio reproduction by the speaker 114. In an embodiment, each of the pre-calibrated and stored RC preset may be different from each other to perform room correction for different locations within the enclosed physical space 108.

The audio reproduction device 102 may be configured to determine the first HRTF associated with the first user 116 based on the frequency responses captured in the received plurality of second audio signals and user-specific information corresponding to the first user 116. For example, the user-specific information may include at least one of dimensions of a head of the first user 116, dimensions of ears of the first user 116, dimensions of ear canals of the first user 116, dimensions of a shoulder of the first user 116, dimensions of a torso of the first user 116, a density of the head of the first user 116, or an orientation of the head of the first user 116. The audio reproduction device may be configured to determine a plurality of HRTF values corresponding to a set of users (now shown in FIG. 1) present within the enclosed physical space 108. Each user of the set of users may have a particular HRTF value associated therewith. The first HRTF may be determined for one or more HRTF filters (shown in FIG. 2) associated with the speaker 114. The determination of the first HRTF is further described, for example, in FIGS. 3A and 3B.

The audio reproduction device 102 may be further configured to control the audio reproduction of the speaker 114 based on the determined RC preset corresponding to the location within the enclosed physical space 108, and further based on the determined first HRTF corresponding to the first user 116 present within the enclosed physical space 108. Thus, the disclosed audio reproduction device 102 may provide automatic control for the room correction of the enclosed physical space 108 based on the determined RC preset, and the determined first HRTF. This may further allow the audio reproduction device 102 to maintain and/or enhance the listening experience of the first user 116 present in the enclosed physical space 108, such that the first user 116 may hear the optimum audio reproduced by the speaker 114.

Figure 2:
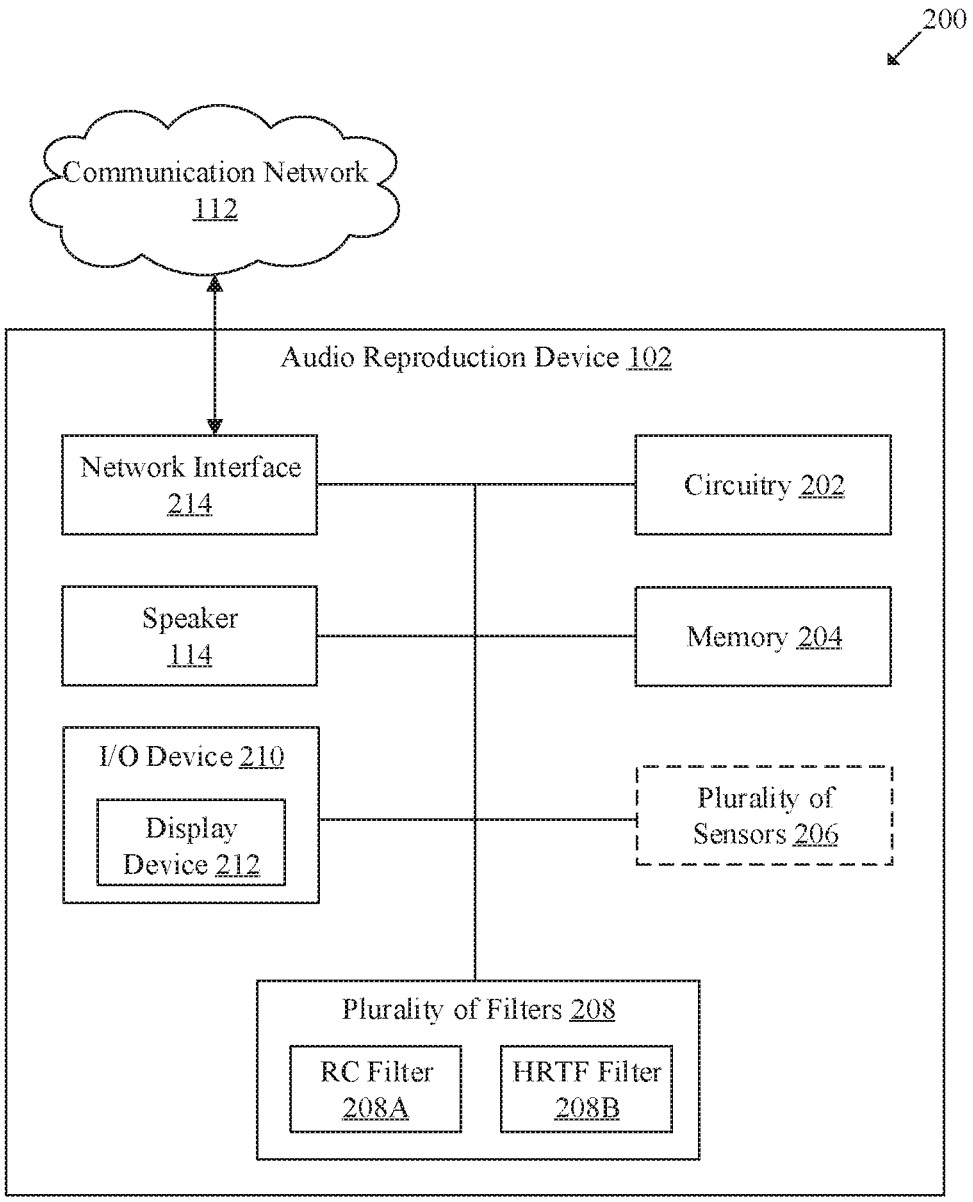
FIG. 2 is a block diagram that illustrates an exemplary audio reproduction device in FIG. 1, in accordance with an embodiment of the disclosure.

FIG. 2 is a block diagram that illustrates an exemplary audio reproduction device, in accordance with an embodiment of the disclosure. FIG. 2 is explained in conjunction with elements from FIG. 1. With reference to FIG. 2, there is shown a block diagram 200 of the audio reproduction device 102. The audio reproduction device 102 may include circuitry 202, a memory 204, a plurality of sensors 206, a plurality of filters 208, an input/output (I/O) device 210, the speaker 114, and a network interface 214. The audio reproduction device 102 may be connected to the communication network 112 through the network interface 214. The plurality of filters 208 may further include a RC filter 208A and a HRTF filter 208B. The I/O device 210 may further include a display device 212. It may be noted that one RC filter 208A and one HRTF filter 208B shown in FIG. 2, is merely presented as an example. In some embodiments, the audio reproduction device 102 may include more than one RC filter and HRTF filter, without deviating from scope of the disclosure.

The circuitry 202 may include suitable logic, circuitry, interfaces, and/or code that may be configured to execute program instructions associated with different operations to be executed by the audio reproduction device 102. For example, some of the operations may include reception of the plurality of second audio signals captured by the plurality of audio capturing devices 106A-106B which may be positioned on the head wearable device 104 of the first user 116 present within the enclosed physical space 108, determination of the RC preset for the one or more RC filters (such as, the RC filter 208A) associated with the speaker 114, determination of the first HRTF associated with the first user 116, and control of the audio reproduction of the speaker 114. The circuitry 202 may include one or more specialized processing units, which may be implemented as a separate processor. In an embodiment, the one or more specialized processing units may be implemented as an integrated processor or a cluster of processors that perform the functions of the one or more specialized processing units, collectively. The circuitry 202 may be implemented based on a number of processor technologies known in the art. Examples of implementations of the circuitry 202 may be an X86-based processor, a Graphics Processing Unit (GPU), a Reduced Instruction Set Computing (RISC) processor, an Application-Specific Integrated Circuit (ASIC) processor, a Complex Instruction Set Computing (CISC) processor, a microcontroller, a central processing unit (CPU), and/or other control circuits.

The memory 204 may include suitable logic, circuitry, interfaces, and/or code that may be configured to store the one or more instructions to be executed by the circuitry 202. The memory 204 may be configured to store the determined RC preset corresponding to the location within the enclosed physical space 108, and store the determined first HRTF corresponding to the first user 116 present within the enclosed physical space 108. The memory 204 may store a correlation (as shown in Table 1 below in FIG. 3B) between the RC preset and the location, and store a correlation between the HRTF and the user, in form of a look-up table. In an example, a particular RC preset (e.g., a first RC preset) may be associated with a particular location within the enclosed physical space 108. In another example, a particular HRTF (e.g., a first HRTF) may be correspond to a particular user present within the enclosed physical space 108. Examples of implementation of the memory 204 may include, but are not limited to, Random Access Memory (RAM), Read Only Memory (ROM), Electrically Erasable Programmable Read-Only Memory (EEPROM), Hard Disk Drive (HDD), a Solid-State Drive (SSD), a CPU cache, and/or a Secure Digital (SD) card.

The plurality of sensors 206 may include suitable logic, circuitry, code, and/or interfaces that may be configured to generate an occupancy signal in order to determine occupancy information of the enclosed physical space 108. The occupancy information may indicate a number of users or listeners present within the enclosed physical space 108. The plurality of sensors 206 may be further configured to transmit the occupancy signal to the circuitry 202. In an embodiment, the plurality of sensors 206 may be located within the enclosed physical space 108. In another embodiment, one or more of the plurality of sensors 206 may be included in the audio reproduction device 102, for example a camera. In such a case, the entire functionality of the one or more of the plurality of sensors 206 may be included in the audio reproduction device 102, without a deviation from scope of the disclosure. Examples of the plurality of sensors 206, may include, but are not limited to, an Infra-red sensor, an image capturing device, a radio-frequency identification (RFID) sensor, a motion sensor, a proximity sensor, a temperature sensor, an occupancy sensor, an ultrasonic sensor, or a microwave sensor. The plurality of sensors 206 are further described, for example, in FIGS. 3A-3B, and 5A-5B.

The plurality of filters 208 may include suitable logic, circuitry, interfaces, and/or code that may be configured to amplify, pass or attenuate some frequency responses of an audio signal. The circuitry 202 may be further configured to determine filter coefficients based on the type of the filter. Examples of the plurality of filters 208 may include, but are not limited to, low pass filter, high pass filter, band pass filter, band reject filter, comb filter, impulse filter or any other audio filter. The RC filter 208A in the plurality of filters 208 may refer to a filter associated with room correction transfer function. The HRTF filter 208B of the plurality of filters 208 may refer to a filter associated with head related transfer function. The RC filter 208A of the speaker 114 and the HRTF filter 208B associated with the speaker 114 may be configured to adjust the audio response or reproduction of the speaker 114 in order to achieve room correction within the enclosed physical space 108. The circuitry 202 may be further configured to determine one or more filter coefficients associated with each of the RC filter 208A and the HRTF filter 208B, separately.

The I/O device 210 may include suitable logic, circuitry, interfaces, and/or code that may be configured to receive an input and provide an output based on the received input. The I/O device 210 may include various input and output devices, which may be configured to communicate with the circuitry 202. For example, the audio reproduction device 102 may receive the user input to initiate audio reproduction, select a first value of the at least one coefficient of the one or more HRTF filters, or a second value of the at least one coefficient of the one or more RC filters, via the I/O device 210. Examples of the I/O device 210 may include, but are not limited to, a touch screen, a keyboard, a mouse, a joystick, a display device (for example, the display device 212), a microphone, or a speaker (for example, the speaker 114).

The display device 212 may include suitable logic, circuitry, and/or interfaces that may be configured to display an output of the audio reproduction device 102. The display device 212 may be utilized to display the values of RC preset and the first HRTF. In some embodiments, the display device 212 may be an external display device associated with the audio reproduction device 102. The display device 212 may be a touch screen which may enable the user (such as, the first user 116) to provide a user-input, via the display device 212, in order to select the first value of the at least one coefficient of the one or more HRTF filters and the second value of the at least one coefficient of the one or more RC filters as shown, for example, in FIG. 4. The touch screen may be at least one of a resistive touch screen, a capacitive touch screen, a thermal touch screen or any other touch screen using which inputs can be provided to the display device 212 or the circuitry 202. The display device 212 may be realized through several known technologies such as, but not limited to, at least one of a Liquid Crystal Display (LCD) display, a Light Emitting Diode (LED) display, a plasma display, or an Organic LED (OLED) display technology, or other display devices. In accordance with an embodiment, the display device 212 may refer to a display screen of a head mounted device (HMD), a smart-glass device, a see-through display, a projection-based display, an electro-chromic display, or a transparent display.

The network interface 214 may include suitable logic, circuitry, interfaces, and/or code that may be configured to facilitate communication between the audio reproduction device 102, the head wearable device 104, the plurality of audio capturing devices 106A-106B, and the server 110, via the communication network 112. The network interface 214 may be implemented by use of various known technologies to support wired or wireless communication of the audio reproduction device 102 with the communication network 112. The network interface 214 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, or a local buffer circuitry.

The network interface 214 may be configured to communicate via wireless communication with networks, such as the Internet, an Intranet, a wireless network, a cellular telephone network, a wireless local area network (LAN), or a metropolitan area network (MAN). The wireless communication may be configured to use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX).

A person of ordinary skill in the art will understand that the audio reproduction device 102 in FIG. 2 may also include other suitable components or systems, in addition to the components or systems which are illustrated herein to describe and explain the function and operation of the present disclosure. A detailed description for the other components or systems of the audio reproduction device 102 has been omitted from the disclosure for the sake of brevity. The operations of the circuitry 202 are further described, for example, in FIGS. 3A and 3B.

Figure 3A:
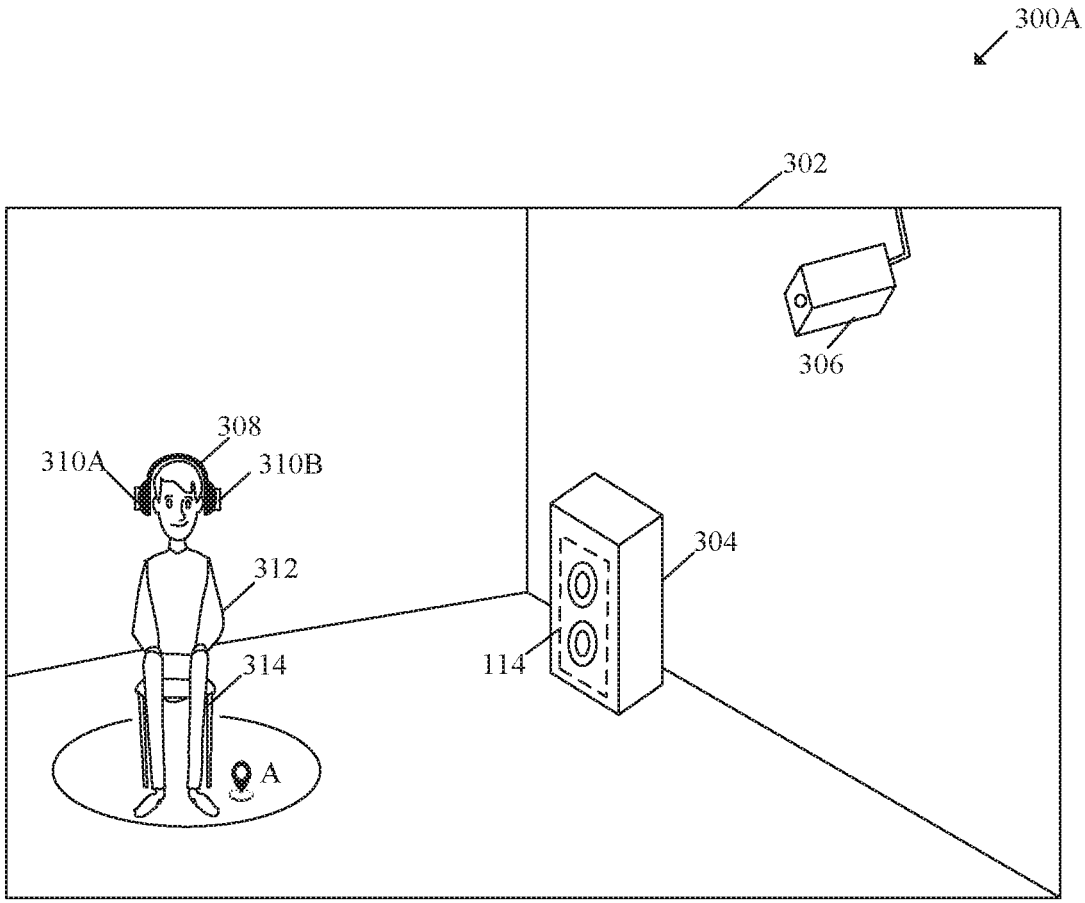
FIGS. 3A and 3B collectively depict exemplary operations of audio reproduction device for audio control based on room correction and head related transfer function, in accordance with an embodiment of the disclosure.
Figure 3B:
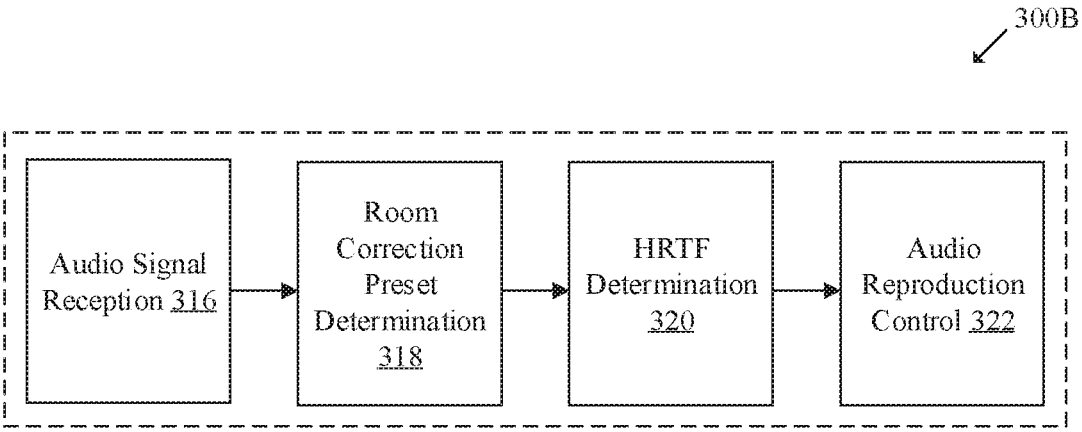

FIGS. 3A and 3B collectively depict exemplary operations of audio reproduction device for audio control based on room correction and head related transfer function, in accordance with an embodiment of the disclosure. FIGS. 3A and 3B are explained in conjunction with elements from FIGS. 1 and 2. With reference to FIG. 3A, there is shown an exemplary scenario 300A. In the exemplary scenario 300, there is shown a room 302 as an exemplary implementation of the enclosed physical space 108 of FIG. 1. There is further shown an audio reproduction device 304, which may be an exemplary implementation of the audio reproduction device 102 of FIG. 1. There is further shown an image capturing device 306 as an exemplary implementation of the plurality of sensors 206. There is further shown a head wearable device 308 as an exemplary implementation of the head wearable device 104, and a plurality of audio capturing devices 310A-310B as an exemplary implementation of the plurality of audio capturing devices 106A-106B. Therefore, the descriptions of the room 302, the audio reproduction device 304, the head wearable device 308, and the plurality of audio capturing devices 310A-310B are omitted from the disclosure for the sake of brevity.

In the scenario 300A, there is further shown a first user 312 (i.e. listener). In an embodiment, for example, the first user 312 may be sitting on a chair 314 in proximity of the speaker 114 of the audio reproduction device 304 located within the room 302. The plurality of audio capturing devices 310A-310B (such as a first audio capturing device 310A and a second audio capturing device 310B) may be positioned on the head wearable device 308 of the first user 312. The first audio capturing device 310A may be positioned on the head wearable device 308, such that the first audio capturing device 310A is in a proximity of a right ear of the first user 312 and the second audio capturing device 3108 may be positioned on the head wearable device 308, such that the second audio capturing device 310B is in a proximity of a left ear of the first user 312, as shown in FIG. 3A. This may allow the plurality of audio capturing devices 106A-106B to perform an optimum measurement of the audio signal (i.e. reproduced by the speaker 114) that may reach to corresponding ears of the first user 312. It may be noted that the image capturing device 306 (i.e. camera) shown as one of the plurality of sensors 206 in FIG. 3A is merely an example. The scenario 300A may include other types of the plurality of sensors 206, without deviating from the scope of the disclosure. Further, it may be noted that first user 312 sitting on the chair 314 as shown in FIG. 3A, is merely an example. The first user 312 may be present in the room 302 in a standing position or in other positions, without deviating from scope of the disclosure.

The circuitry 202 may be configured to control the speaker 114 to reproduce an audio (i.e. sound) based on combination of room correction (RC) and head related transfer function (HRTF). The circuitry 202 may be configured to receive occupancy information (or occupancy signal) from at least one sensor (such as, the image capturing device 306) communicably coupled to the audio reproduction device 102. The occupancy information or occupancy signal may refer to an electrical or digital signal transmitted from the image capturing device 306 to the audio reproduction device 304, via the communication network 112. The occupancy information may indicate a number of users (such as the first user 312) of a set of users present within the enclosed physical space (such as, the room 302).

The image capturing device 306 may include suitable logic, circuitry, code, and/or interfaces that may be configured to capture an image or plurality of images of the room 302. The image capturing device 306 may be further configured to detect the presence of the first user 312 inside the room 302 based on the captured image. The image capturing device 306 may be further configured to determine the number of people (such as, the first user 312) present in the room 302 based on detection of images of multiple people in the captured image. In some embodiments, the image capturing device 306 may provide the captured image, as the occupancy information, to the circuitry 202. The circuitry 202 may detect the number of people captured in the received image based on different image processing techniques, such as, but not limited to face detection algorithms, object detection algorithms, deep learning algorithms, and other image processing algorithms. Examples of the image capturing device 306 may include, but are not limited to, an image sensor, a wide-angle camera, an action camera, a closed-circuit television (CCTV) camera, a camcorder, a digital camera, camera phones, a time-of-flight camera (ToF camera), a night-vision camera, and/or other image capture devices.

In accordance with an embodiment, the circuitry 202 may be configured to receive the occupancy information from the image capturing device 306. The circuitry 202 may be further configured to determine number of people (such as the first user 312), present within the room 302, based on the occupancy information received from the image capturing device 306. For example, with respect to the scenario 300A, the circuitry 202 may determine that one person (such as the first user 312) is present in the room 302 (i.e. enclosed physical space 108) based on the image received from the image capturing device 306.

With reference to FIG. 3B, there is shown a sequence diagram 300B that illustrates exemplary operations 302B to 308B, as described herein. The exemplary operations illustrated in the sequence diagram 300B may start at 302B and may be performed by any computing system, apparatus, or device, such as by the audio reproduction device 102 which may include the speaker 114 in FIG. 1 or the audio reproduction device 304 in FIG. 3A. In an embodiment, the audio reproduction device 304 may be configured to reproduce a first audio signal (i.e. sound, test tone, or musical clip).

Although illustrated with discrete blocks, the exemplary operations associated with one or more blocks of the sequence diagram 300B may be divided into additional blocks, combined into fewer blocks, depending on implementation of the exemplary operations.

At 316, a plurality of second audio signals may be received. In an embodiment, the audio reproduction device 304 may be configured to receive the plurality of second audio signals captured by the plurality of audio capturing devices 310A-310B of the head wearable device 308. The circuitry 202 of the audio reproduction device 304 may receive the plurality of second audio signals from the plurality of audio capturing devices 310A-310B or the head wearable device 308. Each of the plurality of second audio signals may indicate a frequency response captured based on the first audio signal (i.e. sound) reproduced by the speaker (not shown in FIG. 3A) of the audio reproduction device 304. For example, during a calibration phase of the audio reproduction for the room 302, the plurality of audio capturing devices 310A-310B may capture the first audio signal reproduced by the speaker 114. The audio captured by the plurality of audio capturing devices 310A-310B may be an audio signal which may have reached the plurality of audio capturing devices 310A-310B directly or after certain reflections or absorption caused by walls or furniture (not shown) in the room 302. Therefore, the frequency responses of the plurality of second audio signals captured by the plurality of audio capturing devices 310A-310B and a frequency response of the first audio signal reproduced by the speaker 114 may be different which may not be desired by a listener (such as the first user 312).

In an embodiment, each of the plurality of audio capturing devices 310A-310B may be configured to capture one of the plurality of second audio signals that may reach the corresponding ears of the first user 312. The first audio capturing device 310A and the second audio capturing device 3108 may be configured to capture the corresponding second audio signal related to the first audio signal that may reach to the right ear, and the left ear of the first user 312, respectively. The captured frequency response may be associated with an impulse response of the room 302 at the location 'A', shown in FIG. 3A, where the first user 312 may be located. In other words, the frequency response may be associated with an audio response (i.e. as heard by the first user 312 at the location 'A') corresponding to the first audio signal reproduced by the speaker 114.

Each audio signal captured at different locations within the room 302 may have a particular frequency response based on various factors such as, distance of a particular location from the speaker 114 of the audio reproduction device 304, or position of the first user 312 with respect to the speaker 114. In some embodiments, the audio reproduction device 304 may be configured to detect the location of the first user 312 in the room 302, via a location detection device (not shown) associated with the audio reproduction device 102. The location detection device may be integrated or communicatively coupled to the audio reproduction device 304 and may employ technologies such as, but not limited to, a global positioning system (GPS) or a Bluetooth™ beacon, to determine the location of the first user 312 in the room 302. In some embodiments, the audio reproduction device 304 may be configured to receive a user input indicative of the location of the first user 312 in the room 302. The user input may be received from the first user 312, via an I/O device (such as, the I/O device 210) of the audio reproduction device 304. The audio reproduction device 304 may be configured to determine the location of the first user 312 in the room 302 based on the received user input. In some embodiments, the circuitry 202 may be configured to determine the location "A" of the first user 312 based on the images captured by the image capturing device 306.

At 318, a room correction (RC) preset may be determined. In an embodiment, the circuitry 202 of the audio reproduction device 304 may be configured to determine the RC preset for one or more RC filters (such as, the RC filter 208A) associated with the speaker 114 based on the frequency responses captured in the received plurality of second audio signals. The determined RC preset may correspond to the location (for example location "A" in FIG. 3A) of the first user 312 within the room 302. In some embodiments, the circuitry 202 of the audio reproduction device 304 may be configured to retrieve the RC preset from a plurality of RC presets stored in the memory 204 for different locations in the room 302 and for different number of users in the room 302. Each of the stored plurality of RC presets may correspond to pre-calibrated information based on which the audio reproduction of the speaker 114 may be controlled. Each of the stored plurality of RC presets may be pre-calibrated or set for different locations (or positions) of the room 302 and for different number of users in the room 302. For example, a first RC preset may be set for a location of the chair 314 in the room 302. The circuitry 202 may control the speaker 114 to reproduce the first audio signal based on the determined RC preset which may be retrieved or determined for the location "A" of the first user 312 or the chair 314 in the room 302. In some embodiments, the circuitry 202 may compare the average frequency response of the plurality of second audio signals with the frequency response of the first audio signal reproduced by the speaker 114 to determine the RC preset. Based on the comparison, the circuitry 202 may determine the difference between the audio signal reproduced by the speaker 114 and the audio signal which actually reached the first user 312 or captured at the plurality of audio capturing devices 310A-310B. The determined RC preset by indicate different values of amplification or attenuation for different frequencies in the frequency response of the first audio signal, such that the determined difference between the audio signals may be minimal and the first user 312 at the location "A" in the room 302 may listen same audio or sound as actually reproduced by the speaker 114. In such case, the location "A" may be considered as sweet spot based on the room correction performed for the location "A" based on the determined RC preset.

In an embodiment, based on the determined RC preset, the audio reproduction device 304 may equalize the frequency response, or control amplification/attenuation (for example in dB) of certain frequencies of the sound reproduced by the speaker 114 to perform the room correction for the location "A" of the first user 312. The controlled audio reproduction based on the determined RC preset may provide desired or optimal sound experience for the first user 312 present at the location "A" of the chair 314. In some embodiments, the audio reproduction device 304 may store the determined RC preset defined during the calibration phase to achieve the room correction for the location "A" of the first user 312 or the chair 316 in real-time. In a similar manner, the disclosed audio reproduction device 304 may be configured to store the plurality of RC presets for different positions of the room 302. In some embodiments, the audio reproduction device 102 may be configured to determine RC preset using room correction techniques. Examples of the room correction techniques may include, but not limited to, frequency warping, Kautz filters technique, room impulse response (RIR) reshaping technique, homomorphic filtering technique, least-squares optimization technique, or frequency domain deconvolution technique.

In an embodiment, the determined RC preset may include one or more filter coefficients associated with the one or more RC filters (such as the RC filters 208A) of the speaker 114 of the audio reproduction device 304. The one or more filter coefficients associated with the one or more RC filters of the speaker 114 may include information to control the audio reproduced of the speaker 114 to perform the room correction for a particular location within the room 302. In an example, the determined RC preset may indicate one or more filter coefficients that may correspond to at least one of a finite impulse response (FIR) filter coefficients of the RC filter 208A or an infinite impulse response (IIR) filter coefficients of the RC filter 208A. The audio reproduction device 102 may be further configured to store the determined RC preset in the memory 204 in form a look up table. Examples of the stored RC preset for different locations within the room 302, are presented in Table 1, as follows:

TABLE 1

Exemplary RC presets

| RC preset | Location in the room | Filter coefficients |
|---|---|---|
| First RC preset | A | First Coefficients $a_0 \ldots a_n$ |
| Second RC preset | B | Second Coefficients $b_0 \ldots b_n$ |
| Third RC preset | C | Third Coefficients $c_0 \ldots c_n$ |

It may be noted that data provided in Table 1 for the determined RC preset may merely be taken as exemplary data and may not be construed as limiting the present disclosure. In an example, the look-up table (Table 1) may store an association (or relationship) between the RC preset and different locations within the room 302.

In accordance with an embodiment, the audio reproduction device 304 may be configured to determine an average value of the frequency responses captured in the received plurality of second audio signals, to further compare the determined average values in the frequency response with the corresponding values in the frequency response of the first audio signal, and determine the RC preset for the location "A" based on the comparison. The audio reproduction device 304 may be configured to determine the RC preset for the one or more RC filters (such as RC filter 208A) associated with the speaker 114. The audio reproduction device 304 may be configured to determine the average value of the frequency responses captured in the received plurality of second audio signals, such that the one RC preset for the one or more RC filters may be determined for the location 'A', shown in FIG. 3A.

At 320, a first HRTF may be determined. In an embodiment, the circuitry 202 of the audio reproduction device 304 may be configured to determine the first HRTF associated with the first user 312 based on the frequency responses captured in the received plurality of second audio signals and user-specific information corresponding to the first user 312. The circuitry 202 may be configured to determine the first HRTF associated with the first user 312, based on the location of the first user 312 in the room 302 corresponding to the speaker 114 and the user-specific information corresponding to the first user 312. The first HRTF may be associated with the frequency responses of the plurality of second audio signals received by ears of the first user 312 corresponding to the first audio signal reproduced by the speaker 114. The plurality of second audio signals may be captured by the plurality of audio capturing devices 310A-310B of the head wearable device 308 worn by the first user 312, as shown in FIG. 3A. For example, the user-specific information may include, but is not limited to, at least one of dimensions of a head of the first user 312, dimensions of ears of the first user 312, dimensions of ear canals of the first user 312, dimensions of a shoulder of the first user 312, dimensions of a torso of the first user 312, a density of the head of the first user 312, or an orientation of the head of the first user 312. In an embodiment, the user-specific information may be stored in the memory 204 and the circuitry 202 may retrieve the user-specific information for the first user 312 to determine the first HRTF. The circuitry 202 may recognize the first user 312 based on images received from the image capturing device 306.

In an example, the orientation of the head of the first user 312 may include a straight orientation (such as, the first user 312 may be facing the speaker 114), or a sideways orientation (such as, the first user 312 may be side facing the speaker 114). In the sideways orientation, for example, a distance of the right ear of the first user 312 from the speaker 114 may be lesser as compared to a distance of the left ear of the first user 312 from the speaker 114. Therefore, the frequency response of the audio signal captured by the first audio capturing device 310A may be different from the frequency response of the audio captured by the second audio capturing device 310B. In an embodiment, the audio reproduction device 304 may determine the average value of the frequency responses (i.e. average frequency response) of the received plurality of second audio signals captured by each of the plurality of audio capturing devices 310A-310B, to further determine the first HRTF.

In an embodiment, the circuitry 202 may be configured to determine the first HRTF using techniques, for example, localization of sound, phase synthesis or magnitude synthesis. The circuitry 202 may determine the first HRTF for one or more HRTF filters (such as the HRTF filter 208B) associated with the speaker 114. In some embodiments, the circuitry 202 may determine one or more coefficients of the one or more HRTF filters based on the first HRTF determined based on the frequency responses of the plurality of second audio signals. The one or more coefficients associated with the one or more HRTF filters (such as the HRTF filter 208B) of the speaker 114 may correspond to different values (such as gain, amplitude, or delay) for the correction of the frequency response of the first audio signal reproduced by the speaker 114 for the particular listener (such as the first user 312) located at the particular location (such as the location "A" in FIG. 3A). The audio reproduction device 304 may be configured to achieve sound correction for the first user 312 based on the determined values associated with the one or more coefficients of the one or more HRTF filters.

In accordance with an embodiment, the circuitry 202 of the audio reproduction device 304 may be configured to determine an interaural time difference (ITD) and an interaural level difference (ILD) for the first user 312 based on the frequency responses captured in the received plurality of second audio signals. Based on the determined ITD and the determined ILD, the circuitry 202 may be configured to determine the first HRTF associated with the first user 312. The ITD may correspond to a difference between a time taken by the first audio signal (i.e. reproduced by the speaker 114) to reach the left ear of the first user 312 and a time taken by the first audio signal to reach the right ear of the first user 312. In other words, the ITD may correspond to a difference in arrival time of the first audio signal reaching the left ear and the right ear (or captured by the second audio capturing device 3108 and the first audio capturing device 310A, respectively). The ILD may correspond to a difference between a level (such as, intensity or amplitude) of the first audio signal (i.e. reproduced by the speaker 114) reached the left ear of the first user 312 and a level of the first audio signal reached the right ear of the first user 312. The determined ITD and ILD may be associated with a particular user (such as, the first user 312). The determined ITD and ILD may indicate information or cues about a direction or an angle of a sound source (such as the speaker 114) in the room 302 with respect to the listener (i.e. first user 312). The determined ITD and the ILD may vary based on the user-specific information for the first user 312. In an embodiment, the audio reproduction device 304 may be configured to determine the first HRTF based on the determined ITD, the determined ILD, and the frequency responses captured at the location 'A' within the room 302 using techniques, such as (but not limited to) a bilinear interpolation, or a spherical harmonic based interpolation. The determined first HRTF may be utilized to modify the sound (i.e. first audio signal) that may reach the right ear and the left ear of the first user 312 based on the user-specific information.

In accordance with an embodiment, the circuitry 202 may be configured to determine the user-specific information based on the images captured using the image capturing device 306. In an example, the circuitry 202 may be configured to determine the head orientation for the first user 312 based on the images captured using the image capturing device 306. The audio reproduction device 102 may be configured to determine the ITD, and the ILD based on the determined head orientation of the first user 312, and further determine the first HRTF based on the determined ITD and ILD. The circuitry 202 may further store the determined first HRTF for the corresponding user (such as the first user 312) in the memory 204.

At 322, the audio reproduction of the speaker 114 may be controlled. In an embodiment, the circuitry 202 of the audio reproduction device 304 may be configured to control the audio reproduction of the speaker 114 based on the determined RC preset corresponding to the location 'A' within the room 302, and further based on the determined first HRTF corresponding to the first user 312 present within the room 302. The circuitry 202 may be configured to adjust the audio reproduction of the speaker 114 based on the determined RC preset, and the determined first HRTF in order to obtain an optimum output of the speaker 114 for the first user 312 located at the location "A" in the room 302.

In accordance with an embodiment, the circuitry 202 may be configured to determine a first value of at least one coefficient of the one or more HRTF filters (such as the HRTF filter 208B) of the speaker 114 and determine a second value of at least one coefficient of the one or more RC filters (such as the RC filter 208A) of the speaker 114, as described, for example, at 318-320 in FIG. 3B. Based on the determined first value of the at least one coefficient of the one or more HRTF filters and the determined second value of the at least one coefficient of the one or more RC filters, the circuitry 202 may be configured to adjust the first audio signal reproduced by the speaker 114 to control the audio reproduction of the speaker 114. The audio reproduction device 304 may be configured to adjust the at least one coefficient of the one or more HRTF filters and the one or more RC filters 208A, based on the determined first value and the determined second value, respectively to control the audio reproduction. In other words, the audio reproduction device 304 may be configured to re-calibrate the speaker 114 in order to control the audio reproduction of the speaker 114 based on the determined first value of the at least one coefficient of the one or more HRTF filters and the determined second value of the at least one coefficient of the one or more RC filters. In an example, when the first value of the at least one coefficient of the one or more HRTF filters and the second value of the at least one coefficient of the one or more RC filters are equal to pre-defined values, which may be stored in the memory 204, the audio reproduction device 304 achieve sound correction for the particular user (such as the first user 312) located at the particular location (such as the location "A) in the room 302. Thus, the disclosed audio reproduction device 304 may control the audio reproduction of the speaker 114 based on the combination of the room correction (RC) and the head related transfer function (HRTF) related to the location "A" in the room 302 and the user-specific information of the first user 312, respectively.

In accordance with an embodiment, the audio reproduction device 304 may be configured to receive user inputs, via the I/O interface (such as, the I/O device 210) and determine the first value of the at least one coefficient of the one or more HRTF filters and the second value of the at least one coefficient of the one or more RC filters based on the received user inputs. Details of the user inputs to set the coefficients for the room correction and the head related transfer function are provided, for example, in FIG. 4.

Figure 4:
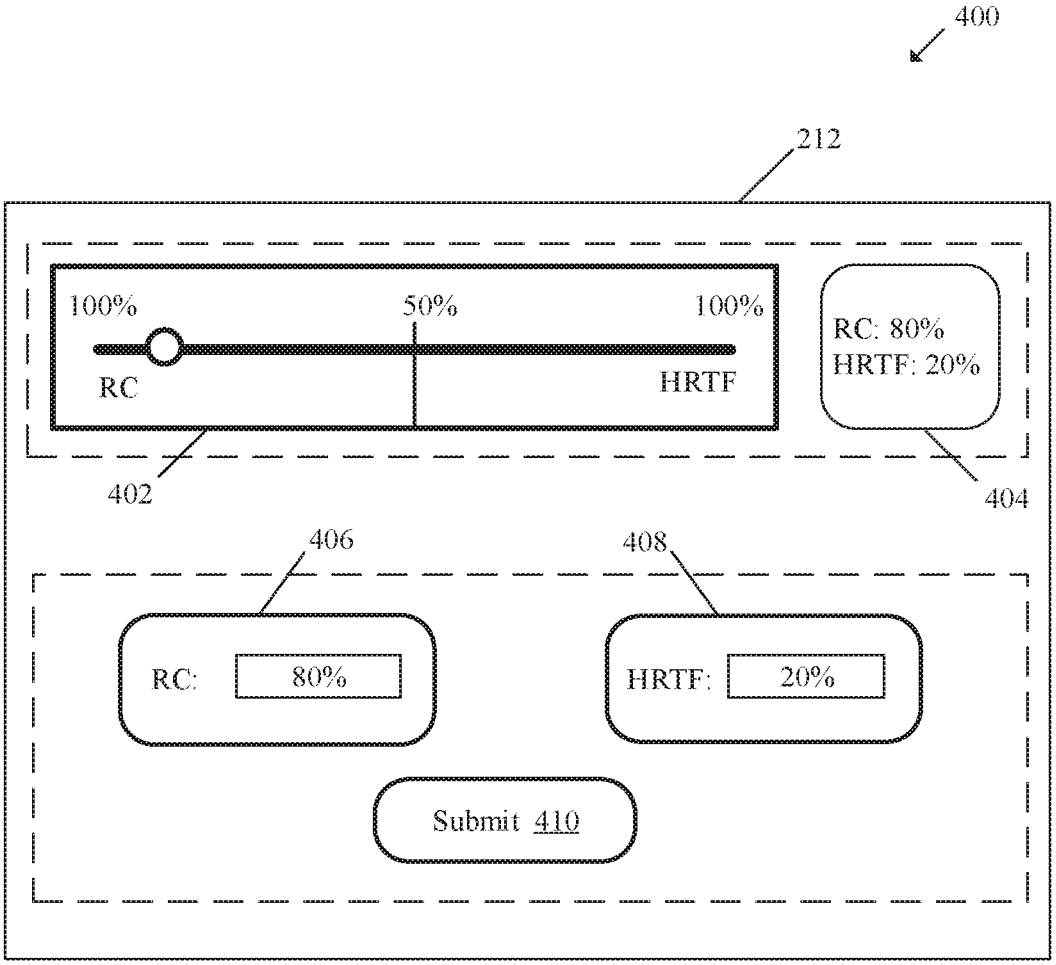
FIG. 4 is a diagram that illustrates an exemplary interface associated with the audio reproduction device to provide room correction and head related transfer function related values, in accordance with an embodiment of the disclosure.

FIG. 4 is a diagram that illustrates an exemplary interface associated with the audio reproduction device to provide room correction and head related transfer function related values. FIG. 4 is explained in conjunction with elements from FIGS. 1, 2, 3A and 3B. With reference to FIG. 4, there is shown an exemplary an interface 400 which may be an exemplary implementation of the I/O device 210 of FIG. 2. In the interface 400, there is shown the display device 212 which may indicate a first user interface (UI) element 402, a second UI element 404, a third UI element 406, a fourth UI element 408, and a fifth UI element 410. The first UI element 402, the third UI element 406, the fourth UI element 408, and the fifth UI element 410 may be associated with input elements of the interface 400, and whereas the second UI element 404 may be associated with an output element of the interface 400.

As shown in FIG. 4, for example, the first UI element 402 may correspond to a slider. The first UI element 402 may be configured to receive a user input (such as, a mouse input, or touch input) indicative of the first value of the at least one coefficient of the one or more HRTF filters (such as HRTF filter 208B) and indicative of the second value of the at least one coefficient of the one or more RC filters (such as RC filter 208A). In some embodiments, the first UI element 402 may indicate a percentage of contribution of room correction (RC) and the head related transfer function (HRTF) in the control of audio reproduction of the speaker 114. In an example in FIG. 4, the slider may indicate that the contribution of the room correction (RC) is eighty percent (i.e. 80%) and the contribution of the head related transfer function (HRTF) is twenty percent (i.e. 20%). The circuitry 202 may be configured to determine first value of the at least one coefficient of the one or more HRTF filters and the second value of the at least one coefficient of the one or more RC filters based on the contribution of the head related transfer function (HRTF) and the room correction (RC) indicated by the first UI element 402. In an embodiment, the second UI element 404 may display the percentage of contribution of the room correction (such as "80%") and the HRTF (such as 20%). In some embodiments, the second UI element 404 may display the first value of the at least one coefficient of the one or more HRTF filters and the second value of the at least one coefficient of the one or more RC filters as determined based on the user inputs provided by the first user 312 on the first UI element 402.

In an embodiment, the third UI element 406 may correspond to, for example, a text box that may be configured to receive the user input indicative of the percentage of contribution of the room correction (as shown in FIG. 4) or indicative of the second value of the at least one coefficient of the one or more RC filters. Similarly, the fourth UI element 408 may correspond to, for example, a text box that may be configured to receive the user input indicative of the percentage of contribution of the room correction (as shown in FIG. 4) or indicative of the first value of the at least one coefficient of the one or more HRTF filters. In an embodiment, the fifth UI element 410 may correspond to, for example, a button input that may be configured to receive the user input to accept and store the first value of the at least one coefficient of the one or more HRTF filters and the second value of the at least one coefficient of the one or more RC filters in the memory in order to further control the audio reproduction of the speaker 114. The disclosed audio reproduction device 304 may receive different percentages or values, as user inputs, for the room correction and the HRTF based on different situations, for example, based on the number of the users in the room 302 or based on stored values for the room correction for different locations in the room 302 or based on stored values for the HRTF associated with different users associated with the room 302, as further described, for example, in FIGS. 5A and 5B. In some embodiments, the user inputs may indicate different percentages or values for the room correction and the HRTF based on other factors such as, but not limited to, a room size, a type of room (such as living room, bed room, kitchen, conference room, or theater), a type of content played back by the speaker 114 (such as high-volume sound, calm music, low-pitch sound, or fast track music).

Figure 5A:
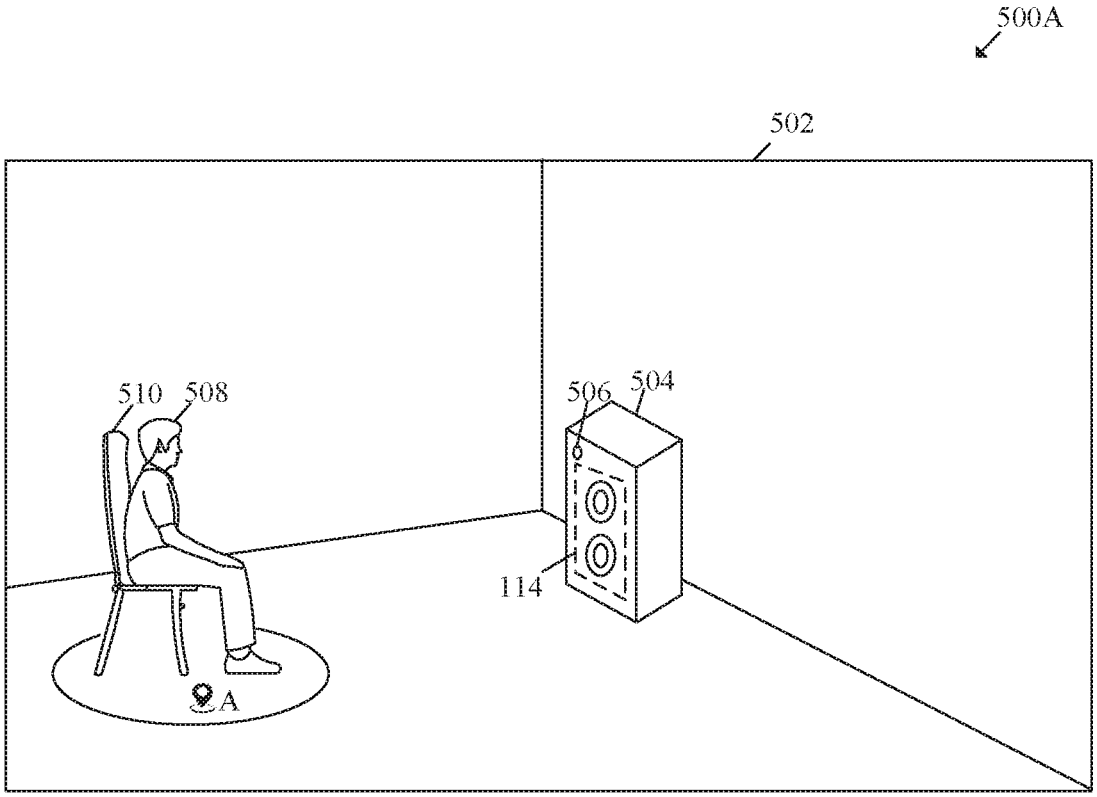
FIGS. 5A and 5B are diagrams that depict exemplary scenarios for audio control based on room correction and head related transfer function, in accordance with an embodiment of the disclosure.
Figure 5B:
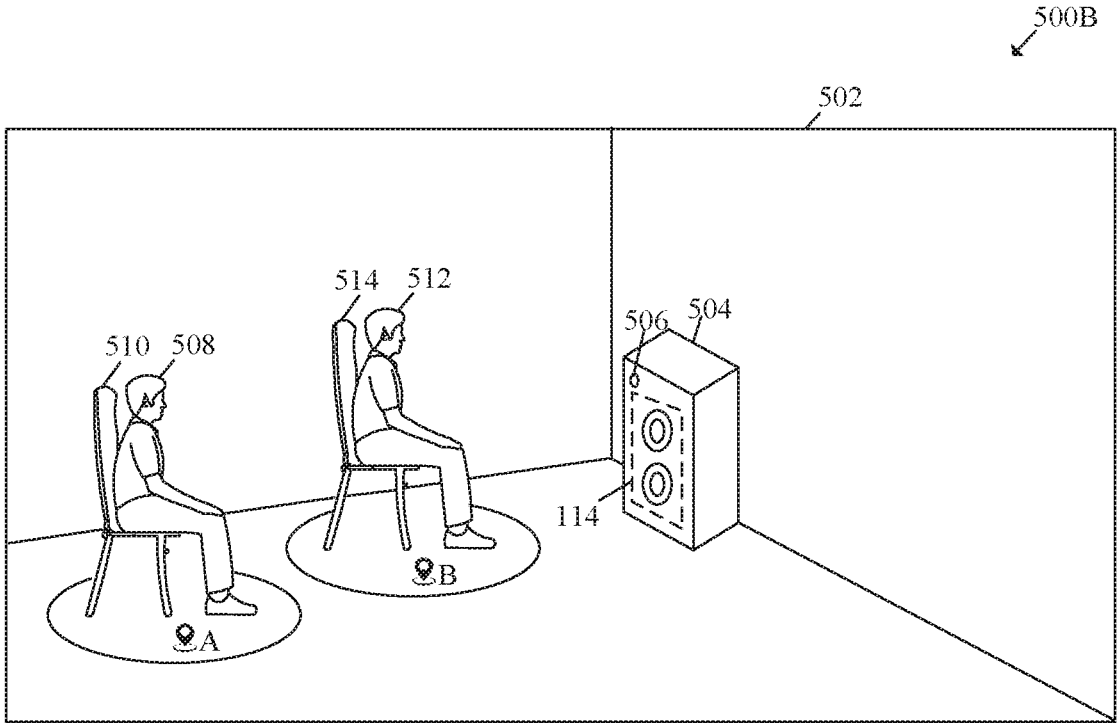

FIGS. 5A and 5B are diagrams that depict exemplary scenarios for audio control based on room correction and head related transfer function, in accordance with an embodiment of the disclosure. FIGS. 5A and 5B are explained in conjunction with elements from FIGS. 1, 2, 3A, 3B, and 4. In the FIGS. 5A and 5B, a run-time implementation of the audio reproduction device 102 may be shown, where the determined RC preset and the determined first HRTF may be stored in the memory 204. With reference to FIG. 5A, there is shown an exemplary scenario 500A. In the exemplary scenario 500A, there is shown a room 502 as an exemplary implementation of the enclosed physical space 108 of FIG. 1. There is further shown an audio reproduction device 504 (including a speaker 114), which may be an exemplary implementation of the audio reproduction device 102, and further shown an image capturing device 506 as an exemplary implementation of one of the plurality of sensors 206. Therefore, the descriptions of the room 502, the audio reproduction device 504, and the image capturing device 506, are omitted from the disclosure for the sake of brevity. In the scenario 500A, there is further shown a first user 508. In an embodiment, the first user 508 may be sitting on a first chair 510 in proximity of the audio reproduction device 504, where the first chair 510 may be located at a first location 'A' within the room 502. It may be noted that the scenario 500A shown in FIG. 5A is presented merely as an example. The scenario 500A may include other types of rooms and different objects present in the room, without deviating from the scope of the disclosure.

The circuitry 202 of the audio reproduction device 504 may be configured to receive the occupancy information from at least one sensor (such as, the image capturing device 506) communicably coupled to the audio reproduction device 504. There is shown, the image capturing device 506 as an internal element of the audio reproduction device 504. The audio reproduction device 504 may be configured to detect a presence of the first user 508 (i.e. one person) based on the received occupancy information. The audio reproduction device 504 may be further configured to retrieve (i.e. from the memory 204) or determine the room correction (RC) preset corresponding to a location (such as, the first location 'A') within the room 502, and the first HRTF corresponding to the first user 508 present within the room 502. For example, in case the first HRTF may be pre-stored or available for the user-specific information of the first user 508 detected in the room 502, the audio reproduction device 504 may be configured to set the contribution of the HRTF as 100% and the contribution of the room correction (RC) as zero percent or set the contribution of the HRTF substantially higher than the room correction (RC). Based on the set contribution in percentage, the circuitry 202 may be further configured to set the first value of the at least one coefficient of the one or more HRTF filters higher than the second value of the at least one coefficient of the one or more RC filters in order to achieve optimum output of the speaker 114 considering the user-specific information of the first user 508 present in the room 502. In such example, the audio reproduction device 504 may provide higher weightage to the HRTF in comparison to the room correction (RC) to further control the audio reproduction based on the combination of the room correction (RC) and the head related transfer function (HRTF). The audio reproduction device 504 may be configured to control the audio reproduction of the speaker 114 based on the determined first value of at least one coefficient of the one or more HRTF filters and the determined second value of the at least one coefficient of the one or more RC filters based on the determination. In another example, in case of the presence of the first user 312 at the location "A" in the room 502 and availability of the RC preset for the location "A," the contribution of the room correction (RC) may be higher than the contribution of the HRTF, for the control of the audio reproduction of the speaker 114 based on the combination of the room correction (RC) and the HRTF. In some embodiments, the audio reproduction device 504 may receive user inputs to set the contribution of the room correction and the HRTF as described, for example in FIG. 4, for the control of the audio reproduction in the room 502.

With reference to FIG. 5B, there is shown an exemplary scenario 500B. In the scenario 500B, there is further shown a second user 512. In an embodiment, the second user 512 may be sitting on a second chair 514 (i.e. in proximity of the speaker 114) located at a second location 'B' within the room 502. The second user 512 may be different from the first user 508. The circuitry 202 of the audio reproduction device 504 may be configured to receive the occupancy information from at least one sensor (such as, the image capturing device 506) communicably coupled to the audio reproduction device 504. The occupancy information may indicate the number of users present within the room 502 (i.e. enclosed physical space 108). For example, with respect to the scenario 500B, the audio reproduction device 504 may determine that two people (such as the first user 508, and the second user 512) are present in the room 502.

The circuitry 202 may be further configured to determine whether a second HRTF is pre-calibrated (or stored in the memory 204) for the second user 512 or not. In case, the second HRTF is not calibrated for the second user 512, the circuitry 202 may be further configured to retrieve the determined RC preset corresponding to a location (such as, the first location 'A') within the room 502, and the determined first HRTF corresponding to the first user 508 present within the room 502 from the memory 204. The circuitry 202 may be configured to set the room correction (RC) contribution percentage or the second value of the at least one coefficient of the one or more RC filters being higher than the HRTF contribution or the first value of the at least one coefficient of the one or more HRTF filters, based on the received occupancy information which may indicate the number of users (such as more than one) in the room 502. For example, the circuitry 202 may be configured to set lower contribution for the HRTF (such as, 20%) or a low first value of the at least one coefficient of the one or more HRTF filters and set higher contribution for the room correction (such as 80%) or a high second value of the at least one coefficient of the one or more RC filters in order to achieve optimum output of the speaker 114 based on the situation that multiple users (i.e. first user 312 and the second user 512) may be located in the room 502. Therefore, the first user 508 and the second user 512 may have an enhanced listening experience associated with the audio reproduced by the speaker 114. The circuitry 202 may be further configured to control the audio reproduction of the speaker 114 based on the determined first value of at least one coefficient of the one or more HRTF filters and the determined second value of at least one coefficient of the one or more RC filters.

In an embodiment, in case the second HRTF is pre-calibrated or stored for the user-specific information of the second user 512, the circuitry 202 may be further configured to determine an average value of one or more parameters (such as equalization parameters) related to the first HRTF for the first user 312 and related to the second HRTF for the second user 512, and accordingly control the audio reproduction of the speaker 114 based on the determined average value. In some embodiments, (in case the second HRTF is not pre-calibrated from the second user 512), the circuitry 202 may be configured to determine an average of the RC presets corresponding to plurality of locations (such as, the first location 'A', and the second location 'B') within the room 502, and further control the audio reproduction of the speaker 114 based on the average of the RC presets (i.e. with higher contribution provided to the room correction than the first HRTF related to the first user 312).

In an embodiment, the audio reproduction device 504 may be configured to set the contribution of the room correction (such as 80%) or the second value of the at least one coefficient of the one or more RC filters being higher than the contribution of the HRTF (such as 20%) or the first value of the at least one coefficient of the one or more HRTF filters based on the received occupancy information which indicates the number of users are more than one (as shown in FIG. 5B). In another example, in case of one user (such as the second user 512) present in the room 502 (i.e. detected based on the occupancy information), and presence of information about the second HRTF for the second user 512, the circuitry 202 may set higher contribution for the HRTF than the room correction (RC), considering the second user 512 may be located at a particular location for which the RC preset by not be pre-stored in the memory 204. In such case, the particular location may be different location than the location "A" and the location "B" shown in FIG. 5B. Thus, the disclosed audio reproduction device 504 may achieve optimum output of the speaker 114 based on different situations (such as number of users, or pre-stored RC presets and HRTF values), such that the first user 508 and the second user 512 may have an enhanced listening experience associated with the audio reproduced by the speaker 114.

In accordance with an embodiment, the circuitry 202 may be configured to determine the first value of at least one coefficient of the one or more HRTF filters and the second value of at least one coefficient of the one or more RC filters based on the received occupancy information which may indicate the number of users present in the enclosed physical space 108. In an embodiment, the circuitry 202 may be configured to set the second value of the at least one coefficient of the one or more RC filters being lower than the first value of the at least one coefficient of the one or more HRTF filters in case the received occupancy information indicates that the number of users present in the room 502 is one. In another embodiment, the circuitry 202 may be further configured to set the second value of the at least one coefficient of the one or more RC filters being higher than the first value of the at least one coefficient of the one or more HRTF filters in case the received occupancy information indicates that the number of users in the room 502 is more than one. In an example, when a single user is present within the room 502, the circuitry 202 may set the HRTF contribution or the first value of the at least one coefficient of the one or more HRTF filters being higher than the room correction (RC) contribution or the second value of the at least one coefficient of the one or more RC filters, in order to achieve optimum output of the speaker 114. In another example, when multiple users are present within the room 502, the circuitry 202 may set the HRTF contribution or the first value of the at least one coefficient of the one or more HRTF filters being lower than the room correction (RC) contribution or the second value of the at least one coefficient of the one or more RC filters, in order to achieve optimum output of the speaker 114.

Figure 6:
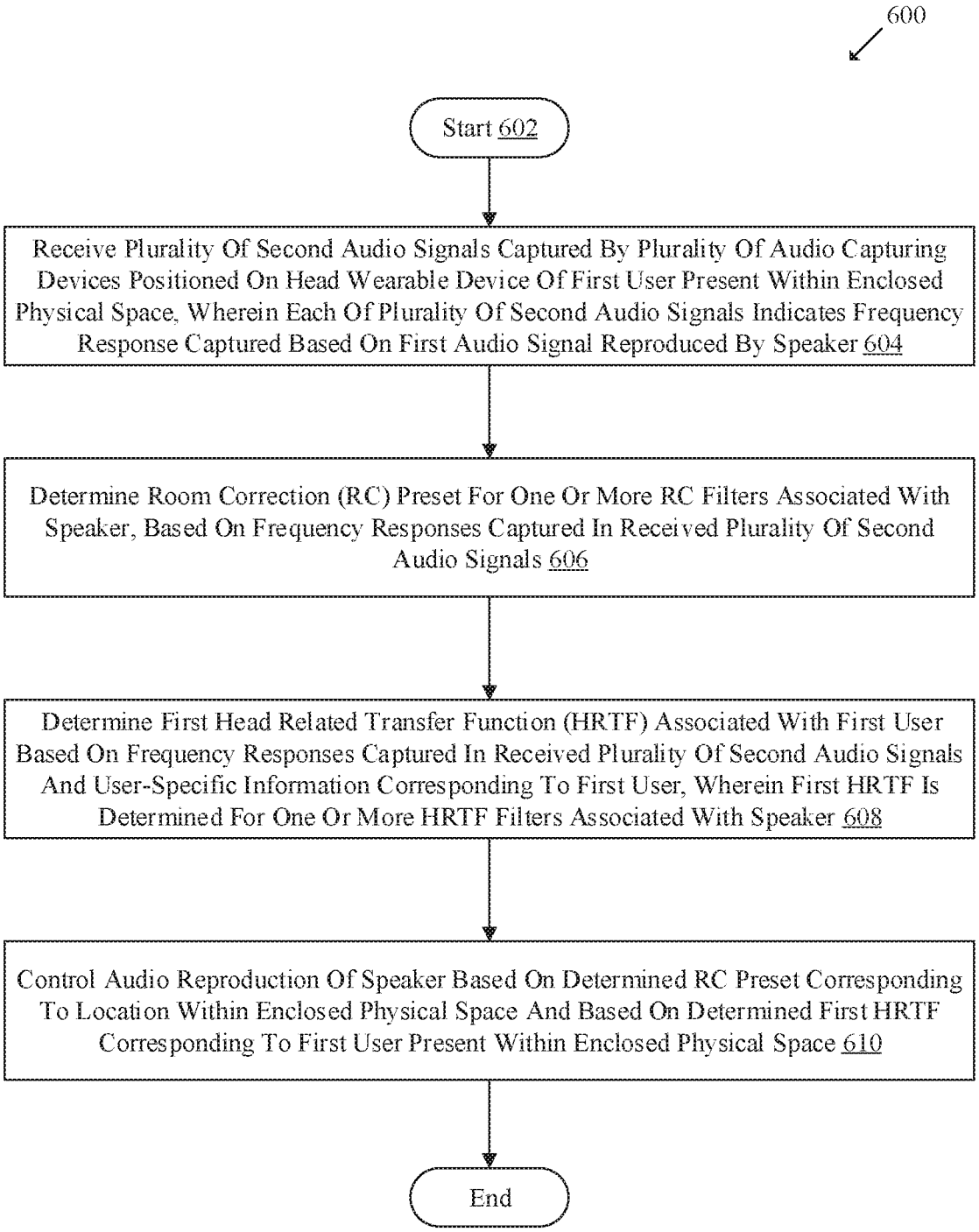
FIG. 6 depicts a flowchart that illustrates an exemplary method for audio control based on room correction and head related transfer function, in accordance with an embodiment of the disclosure.

FIG. 6 depicts a flowchart that illustrates an exemplary method for audio control based on room correction and head related transfer function, in accordance with an embodiment of the disclosure. FIG. 6 is explained in conjunction with elements from FIGS. 1, 2, 3A, 3B, 4, 5A, and 5B. With reference to FIG. 6, there is shown a flowchart 600. The operations of the flowchart 600 may be executed by a computing system, such as the audio reproduction device 102, or the circuitry 202. The operations may start at 602 and proceed to 604.

At 604, a plurality of second audio signals captured by a plurality of audio capturing devices may be received. In one or more embodiments, the circuitry 202 may be configured to receive a plurality of second audio signals captured by the plurality of audio capturing devices 106A-106B that may be positioned on a head wearable device (such as, the head wearable device 104) of a first user (such as, the first user 116) present within an enclosed physical space (such as, the enclosed physical space 108). Each of the plurality of second audio signals may indicate a frequency response captured based on the first audio signal reproduced by the speaker 114, as described, for example, in FIGS. 1 and 3B.

At 606, a room-correction (RC) preset may be determined for one or more RC filters associated with the speaker. In one or more embodiment, the circuitry 202 may be configured to determine the RC preset for the one or more RC filters (such as, the RC filter 208A) associated with the speaker 114, based on the frequency responses captured in the received plurality of second audio signals. The determined RC preset may correspond to a location (such as, the location A) of the first user 116 within the enclosed physical space 108. The determination of the RC preset is described, for example, in FIGS. 3B, 4, 5A, and 5B.

At 608, a first head related transfer function (HRTF) associated with the first user may be determined. In one or more embodiments, the circuitry 202 may be configured to determine the first HRTF associated with the first user 116 based on the frequency responses captured in the received plurality of second audio signals and user-specific information corresponding to the first user 116. The first HRTF may be determined for one or more HRTF filters associated with the speaker 114. The determination of the HRTF is described, for example, in FIGS. 3B, 4, 5A, and 5B.

At 610, the audio reproduction of the speaker may be controlled. In one or more embodiments, the circuitry 202 may be configured to control the audio reproduction of the speaker 114 based on the determined RC preset corresponding to the location 'A' within the enclosed physical space 108, and further based on the determined first HRTF corresponding to the first user 116 present within the enclosed physical space 108 as described, for example, in FIGS. 3B, 5A, and 5B. Control may pass to end.

Although the flowchart 600 is illustrated as discrete operations, such as 604, 606, 608, and 610, the disclosure is not so limited. Accordingly, in certain embodiments, such discrete operations may be further divided into additional operations, combined into fewer operations, or eliminated, depending on the particular implementation without detracting from the essence of the disclosed embodiments.

Various embodiments of the disclosure may provide a non-transitory computer-readable medium having stored thereon, instructions executable by a machine and/or a computer to operate an audio reproduction device (such as the audio reproduction device 102), which may include a speaker (such as, the speaker 114) configured to reproduce a first audio signal. The instructions may cause the machine and/or computer to perform operations that include receiving a plurality of second audio signals captured by a plurality of audio capturing devices (such as, the plurality of audio capturing devices 106A-106B) which may be positioned on a head wearable device (such as, the head wearable device 104) of a first user (such as, the first user 116) present within an enclosed physical space (such as, the enclosed physical space 108). Each of the plurality of second audio signals may indicate a frequency response captured based on the first audio signal reproduced by the speaker 114. The operations may further include determining a room-correction (RC) preset for one or more RC filters (such as, the RC filter 208A) associated with the speaker 114 based on the frequency responses captured in the received plurality of second audio signals. The determined RC preset may correspond to a location (such as, the location 'A') of the first user 116 within the enclosed physical space. The operations may further include determining a first head related transfer function (HRTF) associated with the first user 116 based on the frequency responses captured in the received plurality of second audio signals and user-specific information corresponding to the first user 116. The first HRTF may be determined for one or more HRTF filters (such as, the HRTF filter 208B) associated with the speaker 114. The operations may further include controlling the audio reproduction of the speaker 114 based on the determined RC preset corresponding to the location 'A' within the enclosed physical space 108, and further based on the determined first HRTF corresponding to the first user 116 present within the enclosed physical space 108.

Exemplary aspects of the disclosure may include an audio reproduction device (such as, the audio reproduction device 102) that may include a speaker (such as, the speaker 114) configured to reproduce a first audio signal and circuitry (such as, the circuitry 202) coupled with the speaker 114. The circuitry 202 may be configured to receive a plurality of second audio signals captured by a plurality of audio capturing devices (such as, the plurality of audio capturing devices 106A-106B) which may be positioned on a head wearable device (such as, the head wearable device 104) of a first user (such as, the first user 116) present within an enclosed physical space (such as, the enclosed physical space 108). Each of the plurality of second audio signals may indicate a frequency response captured based on the first audio signal reproduced by the speaker 114. The circuitry 202 may be further configured to determine a room-correction (RC) preset for one or more RC filters (such as, the RC filter 208A) associated with the speaker 114, based on the frequency responses captured in the received plurality of second audio signals. The determined RC preset may correspond to a location (such as, the location 'A') of the first user 116 within the enclosed physical space 108. The circuitry 202 may be configured to determine a first head related transfer function (HRTF) associated with the first user 116 based on the frequency responses captured in the received plurality of second audio signals and user-specific information corresponding to the first user 116. The first HRTF may be determined for one or more HRTF filters associated with the speaker. The circuitry 202 may be further configured to control the audio reproduction of the speaker 114 based on the determined RC preset corresponding to the location 'A' within the enclosed physical space 108, and further based on the determined first HRTF corresponding to the first user 116 present within the enclosed physical space 108.

In accordance with an embodiment, the circuitry 202 may be further configured to determine an average value of the frequency responses captured in the received plurality of second audio signals. Based on the determined average value of the frequency responses captured in the received plurality of second audio signals, the circuitry 202 may be configured to determine the RC preset for the one or more RC filters (such as, the RC filter 208A) associated with the speaker 114. In accordance with an embodiment, the RC preset may comprise one or more filter coefficients associated with the one or more RC filters of the speaker 114.

In accordance with an embodiment, the audio reproduction device 102 may further include a memory (such as, the memory 204) that may be configured to store the determined RC preset corresponding to the location 'A' within the enclosed physical space 108, and store the determined first HRTF corresponding to the first user 116 present within the enclosed physical space 108.

In accordance with an embodiment, the user-specific information comprises at least one of dimensions of a head of the first user 116, dimensions of ears of the first user 116, dimensions of ear canals of the first user 116, dimensions of a shoulder of the first user 116, dimensions of a torso of the first user 116, a density of the head of the first user 116, or an orientation of the head of the first user 116.

In accordance with an embodiment, the circuitry may be further configured to determine an interaural time difference (ITD) and an interaural level difference (ILD) for the first user 116 based on the frequency responses captured in the received plurality of second audio signals. Based on the determined ITD and the determined ILD, the circuitry 202 may be configured to determine the first HRTF associated with the first user 116.

In accordance with an embodiment, the circuitry 202 may be further configured to determine a first value of at least one coefficient of the one or more HRTF filters of the speaker 114 and determine a second value of at least one coefficient of the one or more RC filters of the speaker 114. Based on the determined first value of the at least one coefficient of the one or more HRTF filters and the determined second value of the at least one coefficient of the one or more RC filters, the circuitry 202 may be configured to control the audio reproduction of the speaker 114.

In accordance with an embodiment, the audio reproduction device 102 may further include an Input-Output (I/O) interface (such as, the I/O interface 400). The circuitry 202 may be further configured to receive a user input, via the I/O interface 400, and determine the first value of the at least one coefficient of the one or more HRTF filters and the second value of the at least one coefficient of the one or more RC filters based on the received user input.

In accordance with an embodiment, the circuitry 202 may be further configured to receive occupancy information from at least one sensor (such as, the plurality of sensors 206) communicably coupled to the audio reproduction device 102. The occupancy information may indicate a number of users of a set of users present within the enclosed physical space 108 and the set of users includes the first user 116.

In accordance with an embodiment, the circuitry 202 may be further configured to determine whether a second HRTF is calibrated for a second user (such as, the second user 512) of the set of users. The second user 512 is different from the first user 116. Based on the determination, the circuitry 202 may be configured to determine a first value of at least one coefficient of the one or more HRTF filters and a second value of at least one coefficient of the one or more RC filters.

In accordance with an embodiment, the circuitry 202 may be further configured to set the second value of the at least one coefficient of the one or more RC filters being higher than the first value of the at least one coefficient of the one or more HRTF filters based on the received occupancy information which indicates the number of users as more than one. Based on the determined first value of the at least one coefficient of the one or more HRTF filters and the determined second value of the at least one coefficient of the one or more RC filters, the circuitry 202 may be configured to control the audio reproduction of the speaker 114.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted to carry out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features that enable the implementation of the methods described herein, and which when loaded in a computer system is able to carry out these methods. Computer program, in the present context, means any expression, in any language, code or notation, of a set of instructions intended to cause a system with information processing capability to perform a particular function either directly, or after either or both of the following: a) conversion to another language, code or notation; b) reproduction in a different material form.

While the present disclosure is described with reference to certain embodiments, it will be understood by those skilled in the art that various changes may be made, and equivalents may be substituted without departure from the scope of the present disclosure. In addition, many modifications may be made to adapt a particular situation or material to the teachings of the present disclosure without departure from its scope. Therefore, it is intended that the present disclosure is not limited to the particular embodiment disclosed, but that the present disclosure will include all embodiments that fall within the scope of the appended claims.

What is claimed is:

1. An audio reproduction device, comprising:

a speaker configured to reproduce a first audio signal;

circuitry coupled with the speaker, wherein the circuitry is configured to:

receive a plurality of second audio signals captured by a plurality of audio capturing devices, wherein the plurality of audio capturing devices is on a head wearable device of a first user present at a specific location within an enclosed physical space, the plurality of second audio signals is received at the specific location of the first user, each second audio signal of the plurality of second audio signals indicates a respective frequency response of a plurality of frequency responses of the plurality of second audio signals, the plurality of frequency responses corresponds to the specific location of the first user within the enclosed physical space, and the plurality of frequency responses is captured based on the first audio signal reproduced by the speaker;

determine an average value of the plurality of frequency responses indicated by the received plurality of second audio signals;

determine a room-correction (RC) preset for at least one RC filter associated with the speaker, based on the determined average value of the plurality of frequency responses indicated by the received plurality of second audio signals, wherein the determined RC preset corresponds to the specific location of the first user within the enclosed physical space;

determine a first head related transfer function (HRTF) associated with the first user based on:

the plurality of frequency responses indicated by the received plurality of second audio signals, and user-specific information corresponding to the first user, wherein the first HRTF is determined for at least one HRTF filter associated with the speaker; and control audio reproduction of the speaker based on:

the determined RC preset corresponding to the specific location within the enclosed physical space, and the determined first HRTF corresponding to the first user present within the enclosed physical space.

2. The audio reproduction device according to claim 1, wherein the RC preset comprises at least one filter coefficient associated with the at least one RC filter of the speaker.

3. The audio reproduction device according to claim 1, further comprising a memory configured to:

store the determined RC preset corresponding to the specific location within the enclosed physical space, and store the determined first HRTF corresponding to the first user present within the enclosed physical space.

4. The audio reproduction device according to claim 1, wherein the user-specific information comprises at least one of dimensions of a head of the first user, dimensions of ears of the first user, dimensions of ear canals of the first user, dimensions of a shoulder of the first user, dimensions of a torso of the first user, a density of the head of the first user, or an orientation of the head of the first user.

5. The audio reproduction device according to claim 1, wherein the circuitry is further configured to:

determine an interaural time difference (ITD) and an interaural level difference (ILD) for the first user based on the plurality of frequency responses indicated by the received plurality of second audio signals; and determine the first HRTF associated with the first user based on the determined ITD and the determined ILD.

6. The audio reproduction device according to claim 1, wherein the circuitry is further configured to:

determine a first value of at least one coefficient of the at least one HRTF filter of the speaker;

determine a second value of at least one coefficient of the at least one RC filter of the speaker; and control the audio reproduction of the speaker based on the determined first value of the at least one coefficient of the at least one HRTF filter and the determined second value of the at least one coefficient of the at least one RC filter.

7. The audio reproduction device according to claim 6, further comprising an Input-Output (I/O) interface, wherein the circuitry is further configured to:

receive a user input via the I/O interface; and determine each of the first value of the at least one coefficient of the at least one HRTF filter and the second value of the at least one coefficient of the at least one RC filter, based on the received user input.

8. The audio reproduction device according to claim 1, wherein the circuitry is further configured to receive occupancy information from at least one sensor communicably coupled to the audio reproduction device, the occupancy information indicates a number of users of a set of users present within the enclosed physical space, and the set of users includes the first user.

9. The audio reproduction device according to claim 8, wherein the circuitry is further configured to:

determine whether a second HRTF is calibrated for a second user of the set of users, wherein the second user is different from the first user; and determine a first value of at least one coefficient of the at least one HRTF filter and a second value of at least one coefficient of the at least one RC filter based on the determination of the calibration of the second HRTF for the second user.

10. The audio reproduction device according to claim 9, wherein the circuitry is further configured to:

set the first value of the at least one coefficient of the at least one HRTF filter and the second value of the at least one coefficient of the at least one RC filter, based on the received occupancy information, wherein the received occupancy information which indicates the number of users as more than one, and the second value is set higher than the first value; and control the audio reproduction of the speaker based on the set first value of the at least one coefficient of the at least one HRTF filter and the set second value of the at least one coefficient of the at least one RC filter.

11. A method, comprising:

in an audio reproduction device, which includes a speaker configured to reproduce a first audio signal:

receiving a plurality of second audio signals captured by a plurality of audio capturing devices, wherein the plurality of audio capturing devices is on a head wearable device of a first user present at a specific location within an enclosed physical space, wherein the plurality of second audio signals is received at the specific location of the first user, each second audio signal of the plurality of second audio signals indicates a respective frequency response of a plurality of frequency responses of the plurality of second audio signals, the plurality of frequency responses corresponds to the specific location of the first user within the enclosed physical space, and the plurality of frequency responses is captured based on the first audio signal reproduced by the speaker;

determining an average value of the plurality of frequency responses indicated by the received plurality of second audio signals;

determining a room-correction (RC) preset for at least one RC filter associated with the speaker, based on the determined average value of the plurality of frequency responses indicated by the received plurality of second audio signals, wherein the determined RC preset corresponds to the specific location of the first user within the enclosed physical space;

determining a first head related transfer function (HRTF) associated with the first user based on:

the plurality of frequency responses indicated by the received plurality of second audio signals, and user-specific information corresponding to the first user, wherein the first HRTF is determined for at least one HRTF filter associated with the speaker; and controlling audio reproduction of the speaker based on:

the determined RC preset corresponding to the specific location within the enclosed physical space, and the determined first HRTF corresponding to the first user present within the enclosed physical space.

12. The method according to claim 11, further comprising:

determining an interaural time difference (ITD) and an interaural level difference (ILD) for the first user based on the plurality of frequency responses indicated by the received plurality of second audio signals; and determining the first HRTF associated with the first user based on the determined ITD and the determined ILD.

13. The method according to claim 11, further comprising:

determining a first value of at least one coefficient of the at least one HRTF filter of the speaker;

determining a second value of at least one coefficient of the at least one RC filter of the speaker; and controlling the audio reproduction of the speaker based on the determined first value of the at least one coefficient of the at least one HRTF filter and the determined second value of the at least one coefficient of the at least one RC filter.

14. The method according to claim 13, further comprising:

receiving a user input, via an Input-Output (I/O) interface of the audio reproduction device; and determining each of the first value of the at least one coefficient of the at least one HRTF filter and the second value of the at least one coefficient of the at least one RC filter, based on the received user input.

15. The method according to claim 11, further comprising receiving occupancy information from at least one sensor communicably coupled to the audio reproduction device, wherein the occupancy information indicates a number of users of a set of users present within the enclosed physical space, and the set of users includes the first user.

16. The method according to claim 15, further comprising:

determining whether a second HRTF is calibrated for a second user of the set of users, wherein the second user is different from the first user; and determining a first value of at least one coefficient of the at least one HRTF filter and a second value of at least one coefficient of the at least one RC filter based on the determination of the calibration of the second HRTF for the second user.

17. The method according to claim 16, further comprising:

setting the first value of the at least one coefficient of the at least one HRTF filter and the second value of the at least one coefficient of the at least one RC filter, based on the received occupancy information, wherein the received occupancy information indicates the number of users as more than one, and the second value is set higher than the first value; and controlling the audio reproduction of the speaker based on the set first value of the at least one coefficient of the at least one HRTF filter and the set second value of the at least one coefficient of the at least one RC filter.

18. A non-transitory computer-readable medium having stored thereon, computer-executable instructions that when executed by an audio reproduction device, causes the audio reproduction device to execute operations, the operations comprising:

receiving a plurality of second audio signals captured by a plurality of audio capturing devices, wherein the plurality of audio capturing devices is on a head wearable device of a first user present at a specific location within an enclosed physical space, the plurality of second audio signals is received at the specific location of the first user, each second audio signal of the plurality of second audio signals indicates a respective frequency response of a plurality of frequency responses of the plurality of second audio signals, the plurality of frequency responses corresponds to the specific location of the first user within the enclosed physical space, the plurality of frequency responses is captured based on a first audio signal, and the first audio signal is reproduced by a speaker in the audio reproduction device;

determining an average value of the plurality of frequency responses indicated by the received plurality of second audio signals;

determining a room-correction (RC) preset for at least one RC filter associated with the speaker, based on the determined average value of the plurality of frequency responses indicated by the received plurality of second audio signals, wherein the determined RC preset corresponds to the specific location of the first user within the enclosed physical space;

determining a first head related transfer function (HRTF) associated with the first user based on:

the plurality of frequency responses indicated by the received plurality of second audio signals, and user-specific information corresponding to the first user, wherein the first HRTF is determined for at least one HRTF filter associated with the speaker; and controlling audio reproduction of the speaker based on:

the determined RC preset corresponding to the specific location within the enclosed physical space, and the determined first HRTF corresponding to the first user present within the enclosed physical space.

* * * * *